United States Patent [19]

Paulman et al.

[11] Patent Number: 4,778,004

[45] Date of Patent: Oct. 18, 1988

[54] HEAT EXCHANGER ASSEMBLY WITH INTEGRAL FIN UNIT

[75] Inventors: Roger Paulman, Barrington; Franz X. Wohrstein, Park Ridge, both of Ill.

[73] Assignee: Peerless of America Incorporated, Chicago, Ill.

[21] Appl. No.: 940,910

[22] Filed: Dec. 10, 1986

[51] Int. Cl.[4] ..... F28D 1/00; F28D 1/02; F28D 1/04

[52] U.S. Cl. ..... 165/150; 165/151; 165/152

[58] Field of Search ..... 165/150, 151, 152

[56] References Cited

U.S. PATENT DOCUMENTS

| | | | |
|---|---|---|---|
| 1,789,591 | 1/1931 | McIntyre | 165/150 |
| 1,821,995 | 9/1931 | Wayman | 165/150 |
| 2,119,761 | 6/1938 | Wentworth | 165/150 |
| 2,195,259 | 3/1940 | Ramsaur | 165/150 |
| 2,532,302 | 12/1950 | Hayward | 165/150 X |
| 3,147,800 | 9/1964 | Tadewald | 165/150 X |
| 3,490,524 | 1/1970 | Pasternak | 165/182 |
| 3,546,763 | 12/1970 | Pasternak | 29/157.3 |
| 3,779,311 | 12/1973 | O'Connor et al. | 165/171 |
| 3,780,799 | 12/1973 | Pasternak | 165/150 |
| 4,241,785 | 12/1980 | O'Connor et al. | 165/150 X |

FOREIGN PATENT DOCUMENTS

| | | | |
|---|---|---|---|
| 78580 | 5/1951 | Norway | 165/150 |

*Primary Examiner*—Ira S. Lazarus
*Assistant Examiner*—Richard R. Cole
*Attorney, Agent, or Firm*—Emrich & Dithmar

[57] ABSTRACT

A heat exchanger assembly of the side-entry cross-fin type includes first and second integral fin units, each comprising a single sheet of material provided with a plurality of aligned apertures, the sheet of material being folded in accordian-fashion such that the apertures define a plurality of notches arranged in rows which extend longitudinally of the fin unit. Two of the fin units are assembled together with a single length of heat exchange tube which threads the notches of the fin units, the tube extending over an oval-shaped helical path through the two fin units. In another embodiment, a single folded fin unit is provided with notches in fins on its upper and lower surface, a single length of tube being wrapped around the single fin unit threading the apertures therein, the tube extending in a generally oval-shaped helix path.

15 Claims, 4 Drawing Sheets

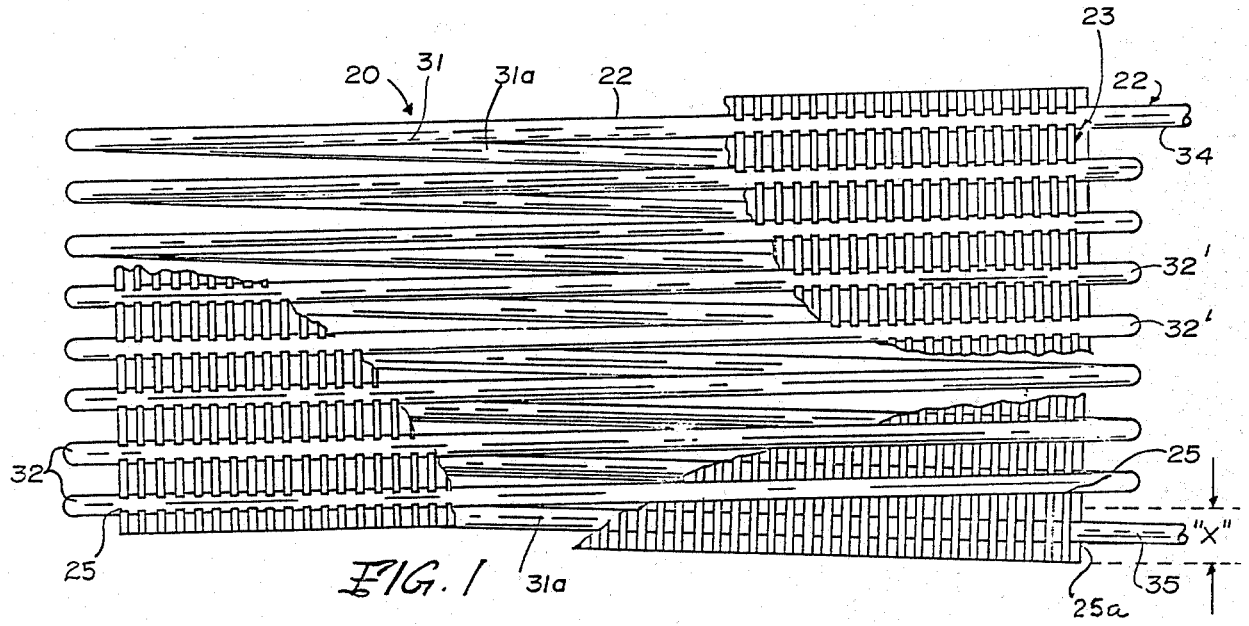
FIG. 1
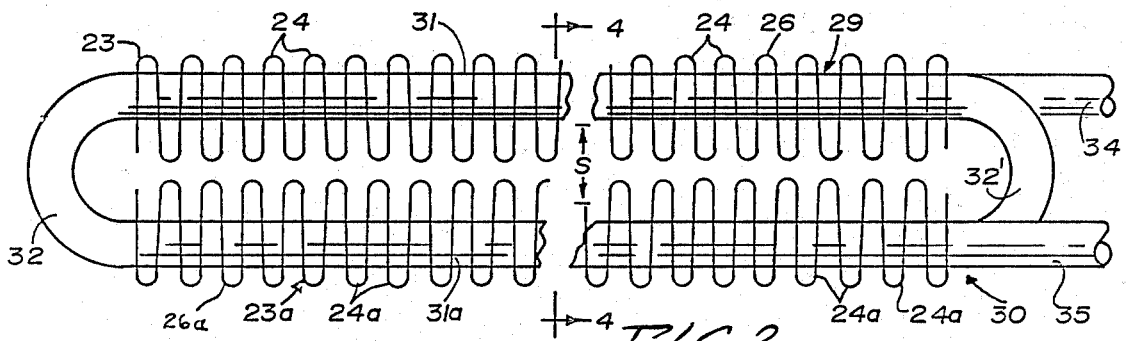
FIG. 2
FIG. 3
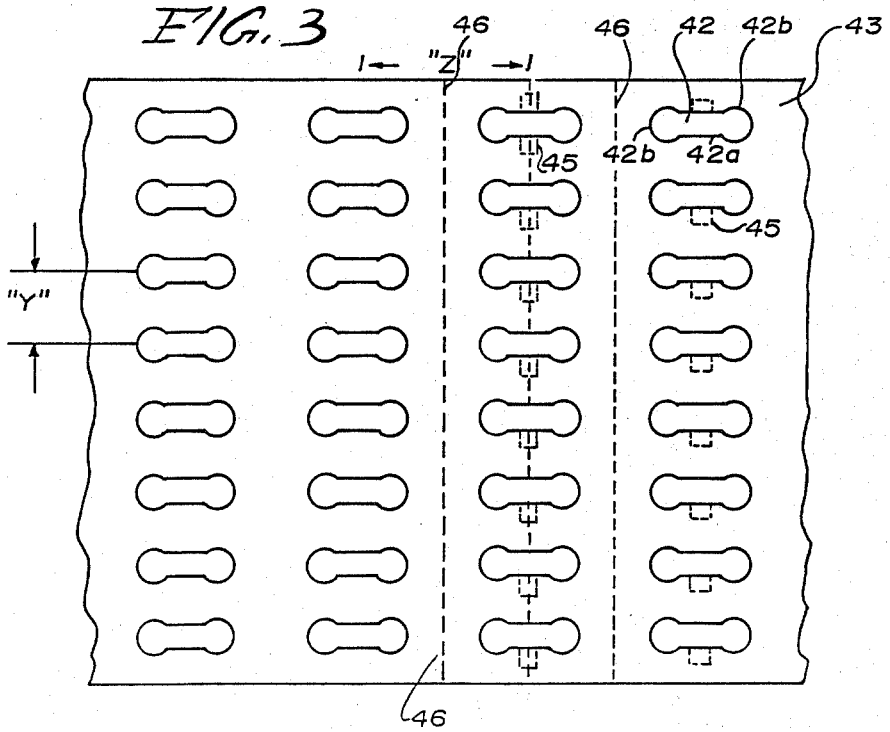

FIG. 5
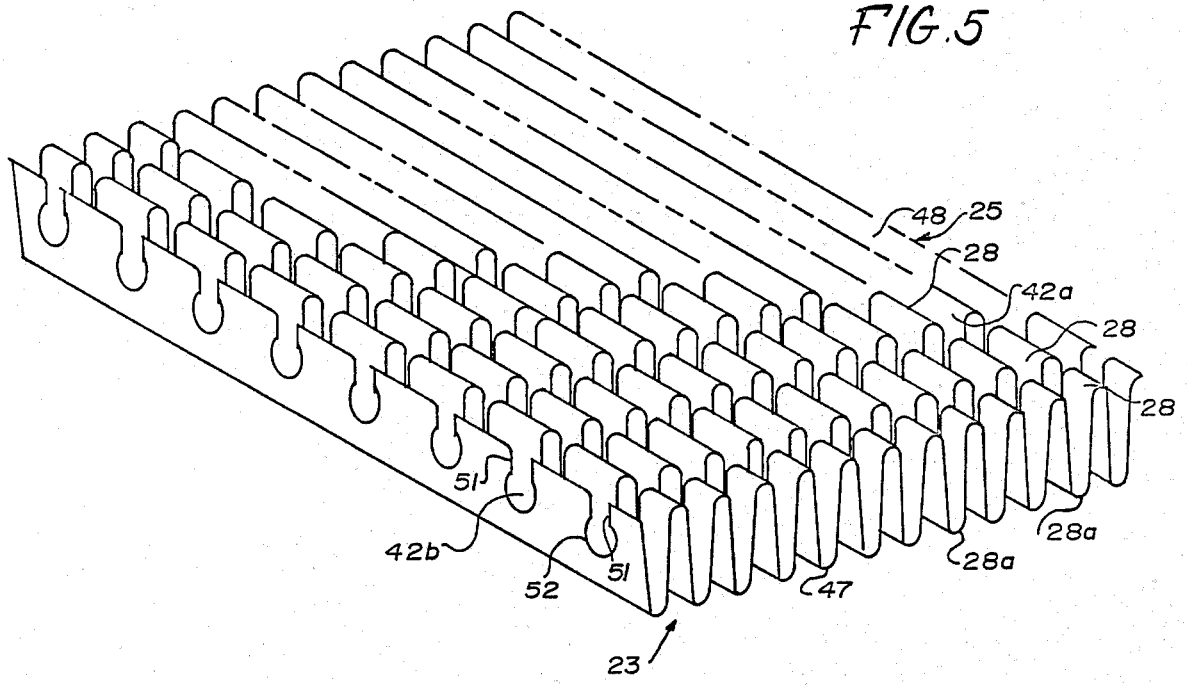
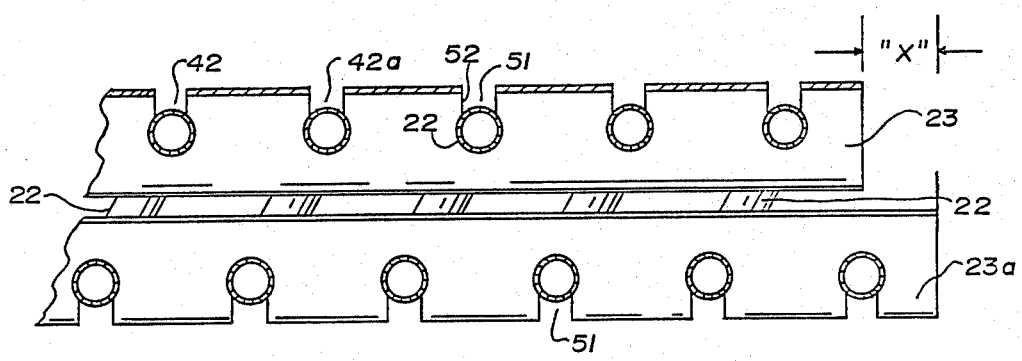
FIG. 4

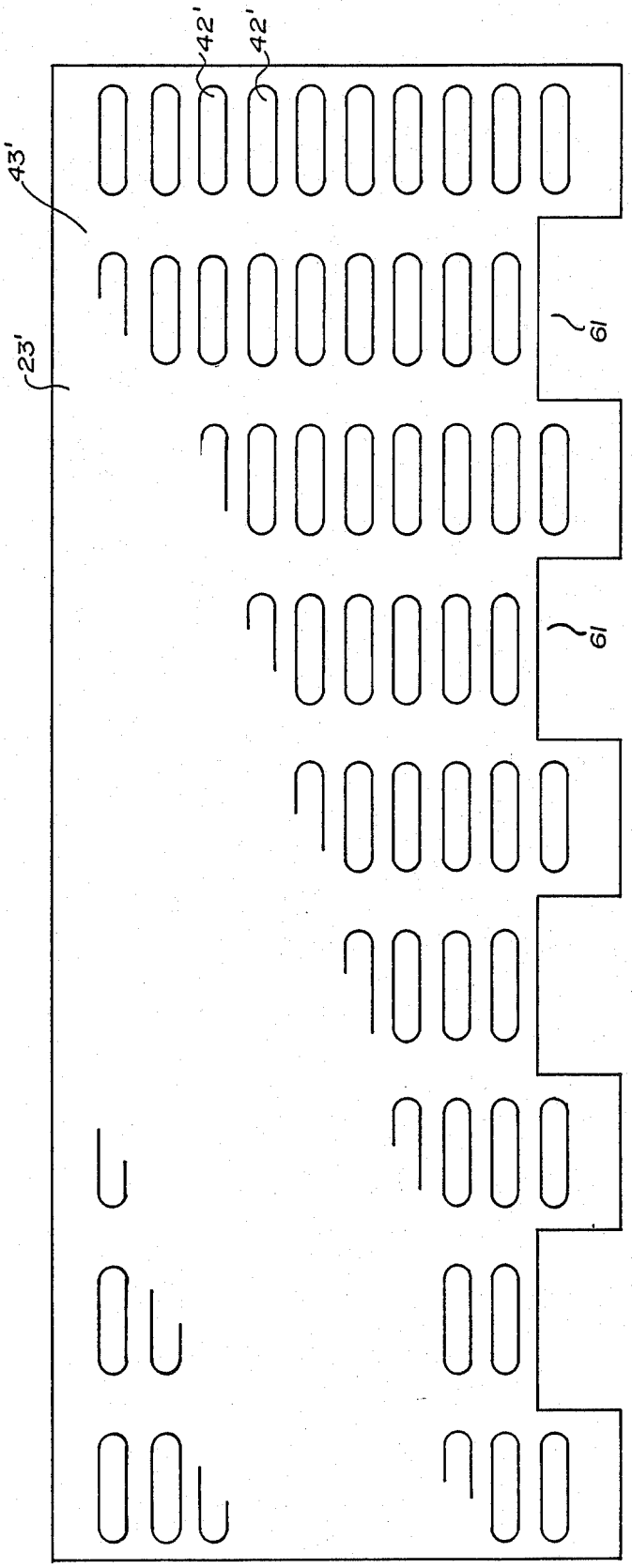
FIG. 6
FIG. 6A
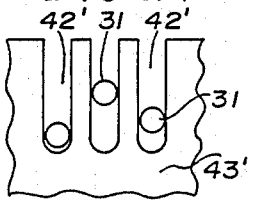

HEAT EXCHANGER ASSEMBLY WITH INTEGRAL FIN UNIT

BACKGROUND OF THE INVENTION

This invention relates to heat exchangers and more particularly to heat exchangers of the cross-fin type and to the method of making the same.

Cross-fin heat exchangers commonly in use are of two types, namely the plate-fin type and the side-entry type. In the plate-fin type of heat exchangers, the tubing forming the coil portion of the heat exchanger is inserted longitudinally through openings formed in the cross-fins of the heat exchanger in inwardly spaced relation to the marginal edges thereof. In side-entry type heat exchangers, the cross-fins thereof have notches formed in their marginal edge portions. The notches are aligned in rows and the tubing is inserted transversely into the aligned notches from row to row.

In known heat exchangers of both types, the fin assemblies comprise a plurality of separate fin strips arranged in an array with the longitudinal openings, or the transverse notches, aligned to receive the tubing. During assembly of such heat exchangers, it is necessary to support the fin assembly in a suitable jig while the tubing is being inserted. Although plate-fin type heat exchangers provide good thermal contact between the cross-fins and the tubing, a shortcoming is that the tubing must be inserted in sections and the sections interconnected at the ends by return bends which are soldered or otherwise connected to the tube sections which define the passes through the fin assemblies. On the other hand, in side-entry type of heat exchangers, the provision of the open-ended notches along the marginal edges of the fin assemblies enables use of a one-piece tube. However, because such heat exchangers have open-ended notches, the cross-fins cannot contact the tubing over its entire outer periphery. The peripheral contact is reduced by at least by the width of the open-end portion of the notch through which the tubing is inserted into the fin assembly. To maximize contact between cross-fins and tubing, it has been common practice in the manufacture of side-entry type heat exchangers to form the notches with an entry portion leading into a body portion, the entry portion being smaller in width than the body portion so that tubing slightly flattened transversely, may be inserted transversely through the entry portion into the body portion and then expanded. Such expansion both interlocks the cross-fins and tubing against removal and enables the tubing to engage the side walls of the body portions along a greater portion thereof.

The fin stock used in heat exchanger fin assemblies is typically of a thickness in the range of 0.007 to 0.010 inches. The size of the fin stock as well as the tubing size determine the overall dimensions of the heat exchanger assembly. Heretofore, in exchanger assemblies employing separate fin strips, the need for sufficient structural strength of the fin assembly dictated the size of the fin stock material and thus the overall size of the heat exchanger assembly. That is, the individual fin strips must be of sufficient thickness to allow the tubing to be inserted into the notches of the assembled fin strips without deforming the fin strips.

SUMMARY OF THE INVENTION

It is therefore an object of the invention to provide a heat exchanger assembly of the side-entry type which is easier to manufacture and assemble than heat exchanger assemblies presently available.

Another object of the invention is to provide a heat exchanger assembly which is more compact and rugged than known heat exchanger assemblies, affording increased efficiency while providing a more compact heat exchanger assembly.

The present invention provides a heat exchanger assembly of the side-entry type which includes a heat transfer array including at least one generally rectangular heat transfer member having a forward surface and a rearward surface, the forward surface defining a plurality of fins each extending transversely of the member, with the fins disposed in a parallel spaced relationship along the longitudinal extent of the member. Each fin includes a pair of strips of a heat transfer material with first web portions interconnecting the pair of strips along first edges thereof, and second web portions interconnecting strips of adjacent fins along second edges thereof defining a unitary structure for the heat transfer member. Each fin has a plurality of notches therein spaced apart transversely of the fin, the notches in the fins being aligned in sets longitudinally of the heat transfer member, defining a plurality of longitudinally extending pathways along the forward surface of said heat transfer member and a single length of heat exchanger tube is wrapped around said heat transfer member longitudinally thereof; in a generally helical form defining alternate first and second pluralities of pass portions along the length of said tubing with a return bend portion between each of said first and second pass portions, said first plurality of parallel pass portions extending longitudinally along the forward surface of the array, each threading a different set of aligned notches, and said second plurality of parallel pass portions extending longitudinally along the rearward surface of the array with return bend portions interconnecting the first and second pass portions.

In one embodiment, the rearward surface of the heat transfer member defines a further plurality of fins each having a plurality of notches therein in the second web portions spaced apart transversely of the fins and aligned in sets longitudinally of the heat transfer member defining a plurality of longitudinally extending pathways extending along the rearward surface of the heat transfer member and threaded by second parallel pass portions of the heat exchanger tube.

In accordance with another embodiment, the heat transfer array comprises first and second heat transfer members each of unitary construction and having a forward surface and a rearward surface, each defining a plurality of aligned notches arranged on its forward surface in rows which extend longitudinally of the fin unit. In assembling the heat transfer members with the heat exchanger tube, the first and second heat transfer members are disposed with their rearward surfaces adjacent to one another in a spaced relation, and the heat exchanger tube is wrapped around the thus assembled heat transfer members threading the notches thereof. One of the heat transfer members extends at an angle relative to the longitudinal axis of the other member whereby the path defined by the heat exchanger tube is in the form of a oval-shaped helix. Alternatively, the tube is preformed in an oval helix shape, and the heat transfer members are then mouned on the preformed tube.

In accordance with a feature of the invention, each heat transfer member comprises a single sheet of fin stock material formed with a plurality of apertures therethrough. The sheet material is folded back and forth upon itself along fold lines in accordion-like fashion, and the apertured portions of the folded sheet define notches on the forward and rearward sides of the member which forms the fin unit in the single member embodiment, and define the notches on the forward surfaces of the two heat transfer members which form the fin unit for the two member embodiment. The notches are aligned in a plurality of transverse rows longitudinally of the unit.

The heat transfer members are of a unitary construction with all of the fin portions of each member being formed integrally therewith. Such unitary construction affords a greater degree of rigidity to the heat exchanger assembly, allowing the array to be formed from a sheet of stock material of a thickness in the range of about 0.003 inches to 0.007 inches. Also, the heat exchange tubing may be formed of a material in the order of 0.012–0.020 inches thick and approximately 0.250–0.500 inches in outside diameter. This results in a smaller more compact heat exchanger assembly than has heretofore been used in heat exchanger assemblies. Because of the dense structure afforded by the use of and heat exchanger tube of smaller size, it has been found, for example, that a heat exchanger assembly reduced in size of up to 1/5 to ⅓ from a known heat exchanger unit, can achieve equal heat transfer efficiency. Because of the helix shaped form and freedom from having to provide fin support during assembly, more tubes and more fins can be arrayed in a smaller volume than was previously possible with the same size tube.

In accordance with a further aspect of the invention, there is provided a method of making a heat exchanger assembly which includes providing a fin unit of unitary construction by folding a sheet of a heat conductive material back and forth upon itself to provide accordianlike folds which define a plurality of fins on a first surface of the fin unit; providing a plurality of notches in each of the fins; providing a one-piece heat exchanger tube; and assembling the fin unit together with the heat exchanger tube with the tube threading the notches of the fin unit.

In one method of making a heat exchanger assembly in accordance with the invention, first and second fin units of unitary construction are provided, each having a plurality of rows of notches formed on forward surfaces thereof the notches being aligned transversely in sets along the longitudinal extent of the fin unit and the first and second fin units are assembled together with a one-piece heat exchanger tube. The fin units are assembled with the heat exchanger tube by wrapping the heat exchanger tube around the first and second fin units, threading the notches in the first and second fin units. Alternatively, the tube is bent to form an oval-shaped helical path and the fin units are pressed onto the preformed tube. Further in accordance with the invention, prior to assembling the tube with the fin units, the diameter of the tube is reduced in a transverse direction to be less than the width of the notches, and when the tube has been assembled with the fin units and threads the notches, the tube is expanded by applying an internal pressure to the tube.

This invention consists of certain novel features and structural details hereinafter fully described, illustrated in the accompanying drawing, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a top plan view of a heat exchanger assembly provided by the present invention;

FIG. 2 is a side elevation view of the heat exchanger assembly of FIG. 1;

FIG. 3 is a fragmentary plan view of one embodiment of a fin unit, prior to folding thereof;

FIG. 4 is a vertical section view taken along the line 4—4 in FIG. 2;

FIG. 5 is a perspective view of the fin unit in its folded form;

FIG. 6 is a plan view of a second embodiment of a fin unit prior to folding;

FIG. 6A is a fragmentary view of the fin unit a 23', after folding, showing tube placement.

DESCRIPTION OF PREFERRED EMBODIMENTS

Figure 7:
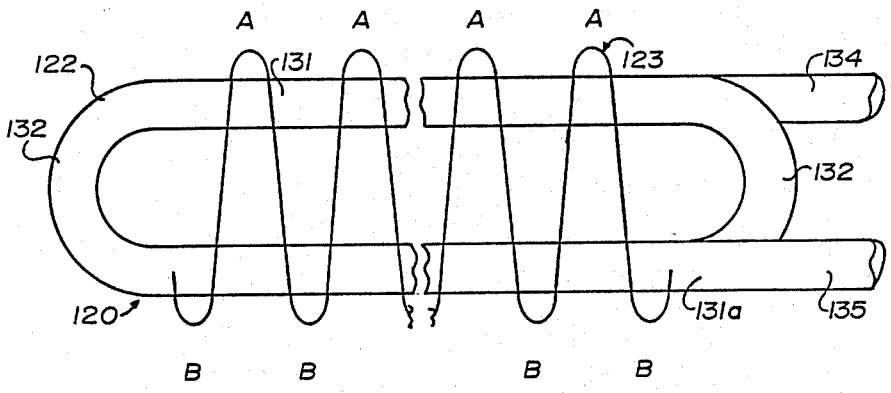
FIG. 7 is a fragmentary side elevation view of a second embodiment of a heat exchanger assembly provided by the present invention.

Referring to FIGS. 1 and 2, the heat exchanger assembly 20 provided by the present invention includes a one-piece heat exchanger tube 22 and two integrally formed fin units 23 and **23*a* each of which defines a plurality of rows of aligned notches or slots 25 and 25*a*, respectively. The single length of tube is threaded in helical fashion through the series notches 25,25*a* provided in respective forward surfaces 26,26*a* of the fin units 22 and 22*a*. The fin units 23 and 23*a* are of the side-entry type and each fin unit 23 and 23*a* comprises a set of fins formed from a single sheet of metal which is folded back and forth upon itself defining a plurality of fins 24 and 24*a* for the fin units 23 and 23*a*. The fins 24,24*a* of each fin unit are alternately connected together at their tops and bottoms along respective web portions 28 and 28*a* as shown in FIG. 4**.

As shown best in FIGS. 1 and 2, the tube 22, which may be formed of any suitable material, such as, for example, aluminium, preferably consists of a unitary tubular member which may have a diameter of about 0.375 inches and a wall thickness of about 0.016 inches. The tube with such dimensions affords sufficient mechanical strength to withstand internal pressure without rupturing while being capable of being flattened when subjected to forces on opposite sides of the tube, to facilitate insertion into the fin units. When the tube 22 is assembled with the fin units **23,23*a*, as shown in FIG. 1, it is formed into a helical pattern having an upper row 29 of passes 31 and a lower row 30 of passes 31*a* spaced apart a distance "s". At the left-hand side (as viewed in FIG. 1) of the assembly, the adjacent passes 31, 31***a* in each of the upper and lower rows 29 and 30 are interconnected at their ends by return bend portions 32 of the one-piece tube 22, and at the right-hand side of the assembly, the passes 31, 31*a* in the two rows 29 and 30 are interconnected by return bend portions 32'. One of the passes 31 in the upper row 29 extends outwardly beyond the fin unit 23 to afford a fluid inlet 34 for the tube 22, and one of the passes 31*a* in the lower row 30 extends outwardly from the fin unit 23*a* to afford a fluid outlet 35 for the tube 22. With this construction, working fluid, such as for example, refrigerant may be fed from a suitable source of supply, such as a compressor, not shown, into the tube 22 through the inlet 34 from which it may flow horizontally through the fin unit 23, toward the left as viewed in FIG. 1, downwardly from pass 31 in the row 29, through the return bend 33 to the pass 31*a* in the lower row 30, and then horizontally to the right, and then back up through the next pass 31 inwardly and horizontally to the left through upper fin unit 23, etc. The fluid thus passes back and forth through the fin units 23 and 23*a* through the passes thereof and finally passes through the outlet 35 in the lower row 30.

Referring to FIGS. 3–5, each of the fin units, such as fin unit 23 is formed from a flat sheet of fin stock 43 (FIG. 3) such as, for example, a suitable metal, such as aluminum, or the like of a thickness in the order of 0.003 to 0.007 inches. The sheet stock is provided with a plurality of apertures, of "dog-bone" shape arranged in a rows spaced along the longitudinal extent of the sheet. Each row includes a plurality of apertures eight in the exemplary embodiment, extending transversely in the row. Each aperture 42 has a narrow center portion 42*a* which extends longitudinally of the sheet and generally circular portions 42*b* at opposite ends of the center portion 42*a*. In one heat exchanger assembly which was constructed, the center line-to-center line spacing "y" between adjacent apertures was 0.750 inches. The dimension "y" can be varied between approximately ½" "and 1" or more depending on the outer diameter of the tube. The center line-to-center line longitudinal spacing "z" between aligned apertures in adjacent rows was 2.07 inches and the radius of the circular portions 42*b* was 0.187 inches. Likewise, the dimension "z" can be varied to provide many fin arrangements. The fin assembly was 21.5 inches long, 8 inches in width and 2 inches in height.

The apertures 42 are formed in the sheet of material, as by a punching or stamping operation, while the sheet is in a substantially flat condition as shown in FIG. 3. Thereafter, the sheet of material 43 is folded back and forth upon itself in accordion-like fashion along the fold lines 45 and 46, for each row, one fold line 45 bisecting the longitudinal axis of the apertures for that row, the other fold line 46 extending transversely of the longitudinal axis of the sheet and intermediate the apertures of adjacent rows. Fold line 45 may comprise segmented creases formed by the die formed from the apertures 42. When the sheet is folded, providing an accordion-type fold for the fin unit, unapertured portions of the sheet along fold lines 46 define the rearward surfaces 27 and 27*a* of the units 23 and 23*a*, the narrow-center portions 42*a* of the apertures define the open-end portions 51 of the notches at the forward surface of the unit for receiving the tube 22 of the heat exchanger. The generally circular portions 42*b* of the apertures define the body portions 52 of the notches, located intermediate the rearward surfaces 27 and forward surface 26 of the unit, and in which the tube 22 is received. The tube receiving circular body portions 52 maximize the area of contact between the fins and the periphery of the tube. The notches are disposed in alignment on the forward surface of the fin unit as illustrated in FIG. 5.

When the two fin units 23 and 23*a* are assembled together with the tube 22, as shown in FIG. 4, the fin unit 23 is offset a distance "x" relative to the longitudinal axis of the fin unit 23*a* as shown in FIG. 1. In one heat exchanger assembly which was constructed, the length of the fin unit was 21.5 inches and the offset length was 1 inch. Thus, the tube 22 when assembled with the fin units 23 and 23*a* extends is an oval-shaped helical path from the fluid inlet 34 at the upper right-hand corner (FIG. 1) of the heat exchanger assembly 20 to the fluid outlet 35 at the lower right-hand corner of the heat exchanger assembly. As shown in FIG. 2, the passes 31 in the upper row 29 and the lower row 30 are spaced apart from one another by a distance "s" which in one assembly which was constructed was $\frac{5}{8}$ inches.

When the tube 22 is assembled with the fin units 23 and 23*a*, the tube is located in the enlarged generally cylindrical body portions 52 of the notches 42 as shown in FIG. 4. During insertion of the tube, the tube may be flattened slightly to enable it to pass through the narrow throat portion 51 of the notches, the tube being expanded, such as by introduction of fluid under pressure into the tube 22, when assembly is complete.

Referring to FIG. 6, there is illustrated a further embodiment for a fin unit 23' which is generally similar to fin unit 23, but which includes generally oval-shaped apertures 42' and which includes a cut out portion 61, generally rectangular in shape, in alternate row positions which define openings at the ends of alternate rows to provide wider channels for the passage of air such as when the heat exchanger is used in a low temperature refrigeration unit provided with a defrosting cycle. As shown in FIG. 6A, after folding, the slot shape allows variations of tube placement from row to row within each coil so as to maximize coil efficiency.

Figure 8:
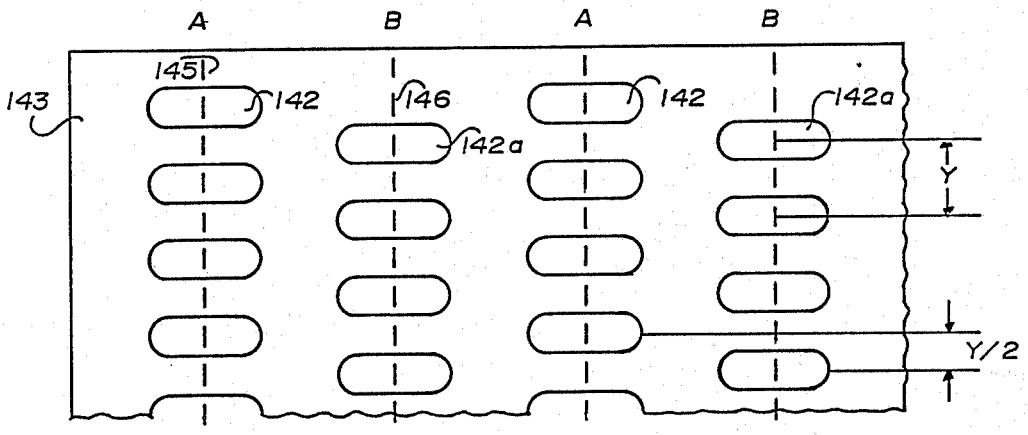
FIG. 8 is a plan view of a third embodiment of a fin unit prior to folding.
Figure 9:
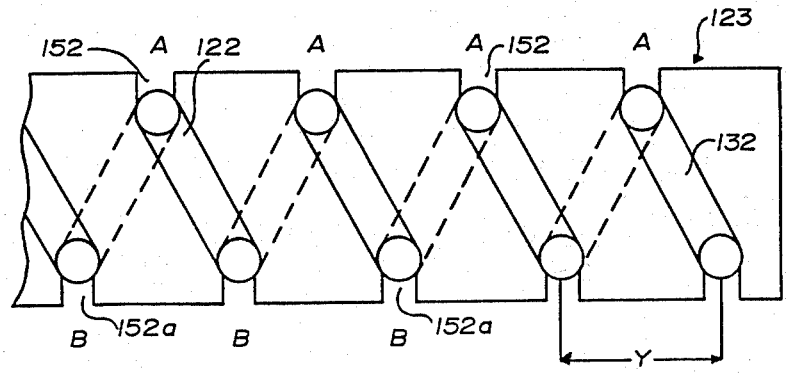
FIG. 9 is a fragmentary front elevation view of the heat exchanger assembly shown in FIG. 7.

Referring to FIGS. 7–9, a further embodiment of a heat exchanger assembly 120 includes a single fin unit 123 upon which is wrapped a one-piece heat exchanger tube 122 which threads aligned notches 152 and 152*a* provided in fins on the upper and lower surfaces of the fin unit 123. The fin unit 123 is the same as the fin units 23, 23*a* except that two sets of apertures 142 and 142*a* are provided for defining the notches 152*a* on the lower surface of the fin unit 123 as well as notches 152 on the upper surface of the fin unit.

Briefly, fin unit 123 is formed from a flat sheet 143 of fin stock (FIG. 8) of aluminum or the like having a thickness in the order of 0.003 to 0.007 inches. A first plurality of sets "A" of aligned apertures 142 provided in the sheet 143 are arranged in rows extending transversely of the sheet. By way of example, each set "A" of apertures may include eight apertures. Each of the apertures 142 is oval-shaped, and its major axis extends parallel to the longitudinal axis of the sheet 143. The apertures 142 in each are aligned along a fold line 145 and spaced apart from adjacent apertures in the same row by a distance "y" which is in the order of 0.750 inches. Similarly, a second plurality of sets "B" of aligned apertures 142*a* provided in the sheet 143 are arranged in rows extending transversely of the sheet, with, for example, eight apertures per set. Each of the apertures 142*a* is oval-shaped, and its major axis extends parallel to the longitudinal axis of the sheet. The apertures 142*a* are aligned along a fold line 146, offset a distance "y"/2 relative to the apertures 142. Thus, after the sheet 143 has been folded in accordion-like fashion, as shown in FIG. 9, to define the fins on its upper and lower surfaces, the sheet 143 being folded over along fold lines 145 and 146 through its apertured portions, the sets of apertures 142*a*, which define the notches 152*a* on the lower surface of the fin unit 123 are located midway between vertical plane bisecting the notches 152 defined by apertures 142 in the upper surface of the fin unit 123.

When the heat exchanger tube 122 is wrapped on the folded fin unit, the upper notches 152 are threaded by the upper passes 131 of the tube and the lower notches 152*a* are threaded by the lower passes 131*a* of the tube, the upper and lower passes being joined by return bend portions 132 so that the heat exchanger tube 123 defines a generally oval-shaped helical path through the fin unit 123.

In manufacturing of the heat exchanger assembly 20, with reference to FIG. 3, first the two fin units 23, 23*a* are produced from separate sheets of fin stock. Each sheet of fin stock material 43 is provided with a plurality of apertures 42 in a punching or stamping operation. Each sheet is then folded along fold lines 45 and 46, providing an accordian-like fold for the fin unit such as fin unit 23 shown in FIG. 5, with the apertured portions of the sheet defining notches 42 in the aligned rows which extend along the longitudinal axis of the unit in a plurality of columns.

The two fin units 23 and 23*a*, thus produced, are positioned with their back surfaces 27, 27*a* adjacent to one another, others in contact with one another, or in a spaced relation as shown in FIG. 4, and with the upper most unit 23 extending at a slight angle (FIG. 1) relative to the lower unit 23*a* to be offset by an amount "x" relative to th side edge of fin unit 23*a*. Then, the one-piece tube 22 is wrapped around the thus arranged fin units 23 and 23*a* and is threaded through the notches 42 in the individual fin units 23 and 23*a* so that the fins 26, 26*a* establish a series of cooling fins which extend across the width of the fin units and bridge the straight pass sections 31 of the tubing 22. The enlarged body portions 52 of the notches 42 to accommodate the tube 22 (FIG. 4) and the narrow entrance throat portions 51 facilitate admission of the tube 22 into the notches 42, the tube being in slightly flattened form. Because of the relatively thin size of the fin stock, lubrication of the tube 22 outer surface is not required during assembly of the tube with the fin units.

After the tube has been wrapped around the fin units and is positioned in the notches 42, the outlet end 35 of the tube 22 is closed and internal pressure is applied to the tube 22 through its inlet 34 to expand the tube back to its original cylindrical shape. This causes the outer wall of the tube 22 mechanically to engage the edges of the enlarged body portions 52 of the notches 42.

It should be recognized that it also is possible to assemble these components in the reverse. First, the heat exchanger tube 22 is bent in an oval helical shape. Then the two fin sections 23, 23*a* are pressed onto the preformed tubing from each side and the tubing is then expanded.

Heat exchanger assembly 120 is manufactured in a manner similar to that for heat exchanger assembly 20 except that a single fin unit is employed and its fin stock is provided with two sets of apertures "A" and "B" (FIG. 8) to define the notches for the upper surface and the lower surface respectively of the folded fin unit. Also, the heat exchanger tube is wrapped around the single fin unit.

The assembled tubing and fin units constitute a basic heat exchanger assembly 20 which may be operatively installed or mounted in a wide variety of installation by means of suitable mounting or support hardware (not shown). The free ends of the tubing which define the inlet 34 and outlet 35 are located on the same side of the unit, the right-hand side as illustrated in FIG. 1.

What is claimed:

1. In a heat exchanger assembly, the combination comprising:

a heat transfer array including at least one heat transfer member generally rectangular in shape and having a forward surface and a rearward surface, said forward surface defining a plurality of fins each extending transversely of said member, said plurality of fins being disposed in a parallel spaced relationship along the longitudinal extent of said member, each fin including a pair of strips of a heat transfer material with first web portions interconnecting the pair of strips along first edges thereof, and second web portions interconnecting strips of adjacent fins along second edges thereof defining a unitary structure for said heat transfer member, each fin having a plurality of notches therein spaced apart transversely of the fin, the notches in said fins being aligned in sets longitudinally of said heat transfer member, defining a plurality of longitudinally extending pathways along the forward surface of said heat transfer member, and a single length of heat exchange tubing wrapped around said heat transfer member longitudinally thereof in a generally helical form defining alternate forward and rearward pass portions along the length of said tubing with a return bend portion between each forward and rearward pass portion, said forward pass portions extending generally parallel to one another longitudinally along the forward surface of said array and each threading a different set of aligned notches and said rearward pass portions extending generally parallel to one another longitudinally along the rearward surface of said array with said return bend portions interconnecting said forward and rearward pass portions.

2. A heat exchanger assembly according to claim 1, wherein said notches are formed in said first web portions and wherein said rearward surface of said member defines a further plurality of fins each having a plurality of notches therein in said second web portions, said notches of said further fins spaced apart transversely of the fins and aligned in sets longitudinally of said heat transfer member defining a plurality of longitudinally extending pathways extending along the rearward surface of said heat transfer member and threaded by said second parallel pass portions of said heat exchange tubing.

3. A heat exchanger assembly acccording to claim 2, wherein the sets of notches on said forward surface offset transversely of the sets of notches on said rearward surface.

4. A heat exchanger assembly according to claim 2, wherein said heat transfer member comprises a single sheet of a heat radiating material having a plurality of generally oval-shaped apertures formed therein and aligned in sets of apertures which extend transversely of said sheet, said sheet being folded back and forth upon itself in accordian-like fashion along a plurality of fold lines each extending transversely of said sheet and transversely to the longitudinal axis of a different set of said apertures, providing a plurality of folds which define said fins and the notches therein.

5. A heat exchanger assembly according to claim 1, wherein said array comprises first and second heat transfer members disposed with their rearward surfaces adjacent to one another, said heat exchange tubing being wrapped around the thus assembled heat transfer members with its forward and rearward pass portions threading the notches in respective forward surfaces of said first and second heat transfer members.

6. A heat exchanger assembly according to claim 5, wherein one of said heat transfer members extends at an angle relative to the longitudinal axis of the other one of said heat transfer members whereby the pathways defined along the surfaces of the assembled heat transfer members are in the form of an oval-shaped helix.

7. In a heat exchanger assembly, the combination comprising:

a heat transfer array generally rectangular in shape and having a forward surface and a rearward surface, said array including a flat sheet of a heat radiating material folded back and forth upon itself in accordion-like fashion defining a plurality of fins on the forward surface of said array, each fin extending transversely of said array with said plurality of fins being disposed in a parallel spaced relationship along the longitudinal extent of said array; each fin having a plurality of notches therein spaced apart transversely of the fin, the notches in said fins being aligned in sets longitudinally of said array defining a plurality of longitudinally extending pathways along the forward surface of said array;

and a single length of heat exchange tubing wrapped around said heat transfer array longitudinally thereof in a generally helical form, defining alternate forward and rearward pass portions along the length of said tubing with a return bend portion between each forward and rearward pass portion, said forward pass portions extending generally parallel to one another longitudinally along the forward surface of said array and each threading a different set of aligned notches and said rearward pass portions extending generally parallel to one another longitudinally along the rearward surface of said array with said return bend portions interconnecting said forward and rearward pass portions.

8. In a heat exchanger assembly, the combination comprising:

a first fin unit;

a second fin unit;

each of said fin units being of a unitary construction and having a forward surface and a rearward surface, each fin unit defining a plurality of fins arranged on its forward surface in rows which extend longitudinally of the fin unit each fin having a plurality of notches therein spaced apart transversely of the fin and the notches in said fins being aligned in sets extending longitudinally of the fin unit, defining parallel pathways extending along the forward surfaces of said fin units; and a single length of heat exchange tubing;

said first and second fin units being assembled together with rearward surfaces adjacent to one another, and said heat exchange tubing being wrapped around the thus assembled fin units longitudinally thereof threading said notches thereof.

9. A heat exchanger assembly according to claim 8, wherein said first and second fin units each comprise a single sheet of material having a plurality of apertures formed therethrough, said sheet of material being folded back and forth upon itself in accordion-fashion providing a plurality of folds which define said fins and folded over apertured portions of said sheet defining said notches.

10. A heat exchanger assembly according to claim 8, wherein one of said fin units extends at an angle relative to the longitudinal axis of the other fin unit whereby the path through said assembled fin units defined by said heat exchange tubing is in the form of an oval-shaped helix.

11. A heat exchanger assembly according to claim 9, wherein said tubing carries said first and second fin units, maintaining their rearward surfaces in spaced apart relation.

12. A heat exchanger assembly according to claim 9, wherein said sheet of material is of a thickness in the range of about 0.003 inches to 0.007 inches.

13. A heat exchanger assembly according to claim 9, wherein the thickness of the walls of said tubing is in the order of 0.016 inches.

14. In a heat exchanger assembly, the combination comprising:

a heat transfer fin array having first and second parallel surfaces with a plurality of fins arranged on its first and second surfaces in rows which extend longitudinally of said fin array and each fin having a plurality of notches therein spaced apart transversely of the fin, the notches in said fins being aligned in sets longitudinally of said fin array, defining a plurality of longitudinally extending passageways on the parallel opposed surfaces of said fin array; and a single length of heat exchange tubing, said heat exchange tubing being wrapped around the fin array longitudinally thereof and threading said notches thereof on the parallel surfaces, and extending through said fin array along a path in the form of an oval-shaped helix.

15. A heat exchanger assembly according to claim 14, wherein said fin array comprises said first and second fin units each comprising a single sheet of material having a plurality of apertures formed therethrough, said sheet of material being folded back and forth upon itself in accordion-fashion providing a plurality of folds which define said fins and with the folded over apertured portions of said sheet defining said notches.

* * * * *